US010252314B2

(12) United States Patent
Nohara et al.

(10) Patent No.: US 10,252,314 B2
(45) Date of Patent: Apr. 9, 2019

(54) METHOD OF MANUFACTURING PURE NIOBIUM PLATE END-GROUP COMPONENTS FOR SUPERCONDUCTING HIGH FREQUENCY ACCELERATOR CAVITY

(71) Applicants: SHINOHARA PRESS SERVICE CO., LTD., Funabashi-shi, Chiba (JP); Kiyohiko Nohara, Chiba (JP); INTER-UNIVERSITY RESEARCH INSTITUTE CORPORATION HIGH ENERGY ACCELERATOR RESEARCH ORGANIZATION, Tsukuba-shi, Ibaraki (JP)

(72) Inventors: Kiyohiko Nohara, Chiba (JP); Nobuyuki Kawabata, Funabashi (JP); Hideyoshi Nakamura, Funabashi (JP); Kyohei Miyajima, Funabashi (JP); Masayuki Shinohara, Funabashi (JP); Hitoshi Hayano, Tsukuba (JP); Akira Yamamoto, Tsukuba (JP); Takayuki Saeki, Tsukuba (JP); Shigeki Kato, Tsukuba (JP); Masashi Yamanaka, Tsukuba (JP)

(73) Assignees: SHINOHARA PRESS SERVICE CO., LTD., Funabashi-shi (JP); Kiyohiko Nohara, Chiba-shi (JP)

( * ) Notice: Subject to any disclaimer, the term of this patent is extended or adjusted under 35 U.S.C. 154(b) by 69 days.

(21) Appl. No.: 15/379,889

(22) Filed: Dec. 15, 2016

(65) Prior Publication Data

US 2017/0113259 A1 Apr. 27, 2017

Related U.S. Application Data

(63) Continuation of application No. PCT/JP2015/067221, filed on Jun. 15, 2015.

(30) Foreign Application Priority Data

Jun. 16, 2014 (JP) ..... 2014-123673

(51) Int. Cl.
*H01R 43/00* (2006.01)
*B21D 28/02* (2006.01)
(Continued)

(52) U.S. Cl.
CPC ..... *B21D 28/02* (2013.01); *B21J 1/003* (2013.01); *B21J 1/06* (2013.01); *B21J 5/00* (2013.01);
(Continued)

(58) Field of Classification Search
CPC ... B21D 28/02; B21J 13/02; B21J 1/06; B21J 5/00; H01P 11/001; Y10T 29/49016; Y10T 29/49117
(Continued)

(56) References Cited

U.S. PATENT DOCUMENTS 6,087,940 A * 7/2000 Caperna ..... H01F 5/003 29/846
9,055,659 B2 * 6/2015 Hitomi ..... B21D 51/16
9,502,631 B2 * 11/2016 Nohara ..... H05H 7/20

* cited by examiner

*Primary Examiner* — Donghai D Nguyen
(74) *Attorney, Agent, or Firm* — Westerman, Hattori, Daniels & Adrian, LLP

(57) ABSTRACT

Targeting mass production, the present invention provides an advanced method of manufacturing pure niobium plate end-group components from pure niobium plate material for superconducting high frequency accelerator cavity by means of innovative shear-blanking followed by innovative forging procedures, wherein the invention is to convert the procedure/production method from the conventional machining or waterjet cutting followed by the conventional cold forging to
(Continued)

the whole press-forming The invention gives the drastic effects on cost-effectiveness and press-performance.

18 Claims, 8 Drawing Sheets

(51) Int. Cl.

| | |
|---|---|
| ***B21J 1/06*** | (2006.01) |
| ***B21J 5/00*** | (2006.01) |
| ***B21J 13/02*** | (2006.01) |
| ***H01P 11/00*** | (2006.01) |
| ***B21J 1/00*** | (2006.01) |
| ***H01P 1/208*** | (2006.01) |

(52) U.S. Cl.
CPC ..... *B21J 13/02* (2013.01); *H01P 1/2082* (2013.01); *H01P 11/001* (2013.01); *H01P 11/007* (2013.01)

(58) Field of Classification Search
USPC ..... 29/600, 825
See application file for complete search history.

[Fig.3A]
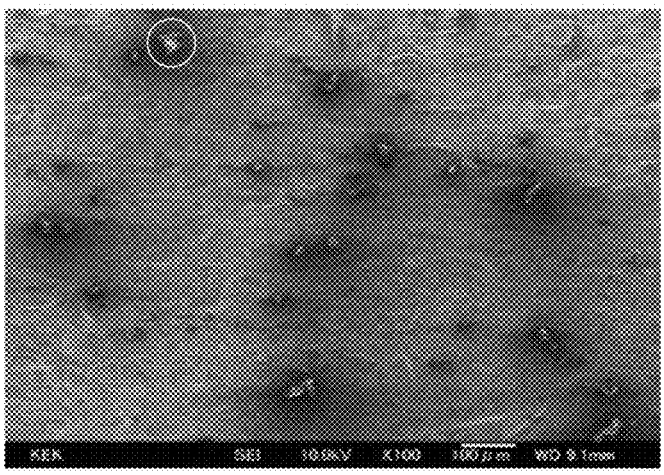
[Fig.3B]
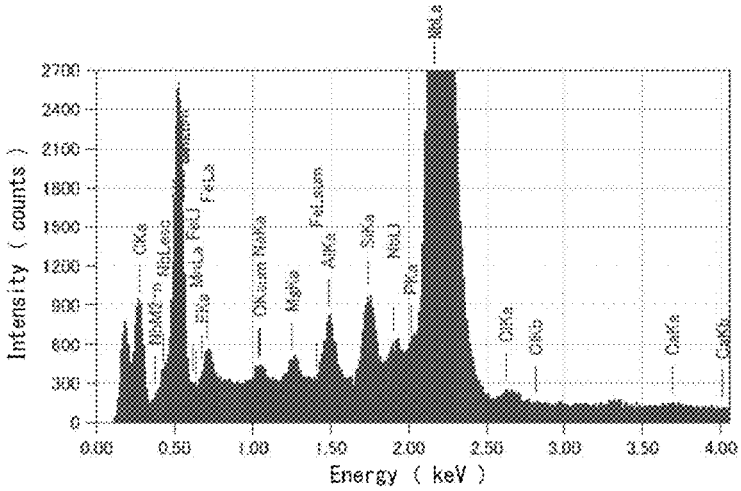

[Fig.5A]
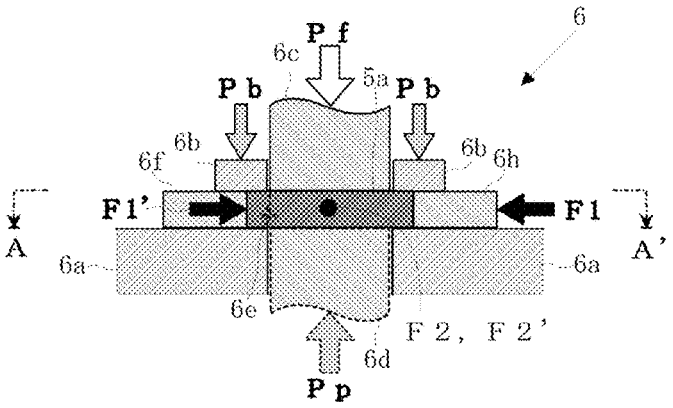
[Fig.5B]
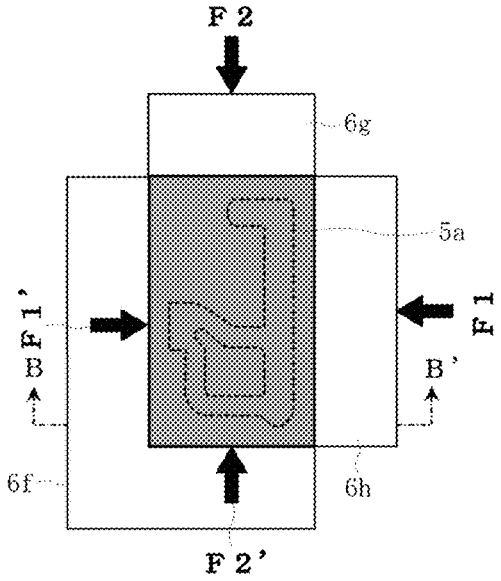

[Fig. 6]
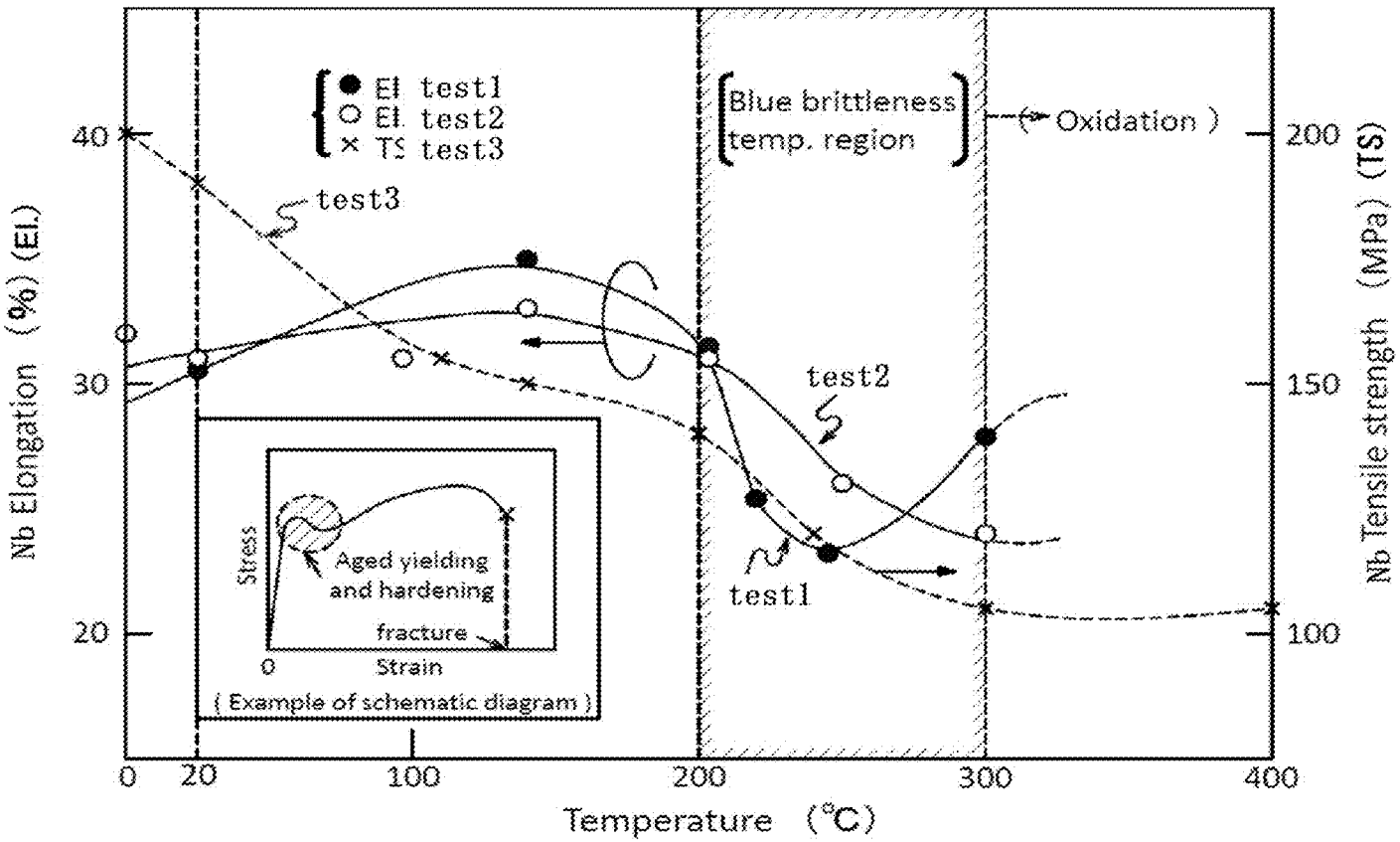

[Fig. 7]
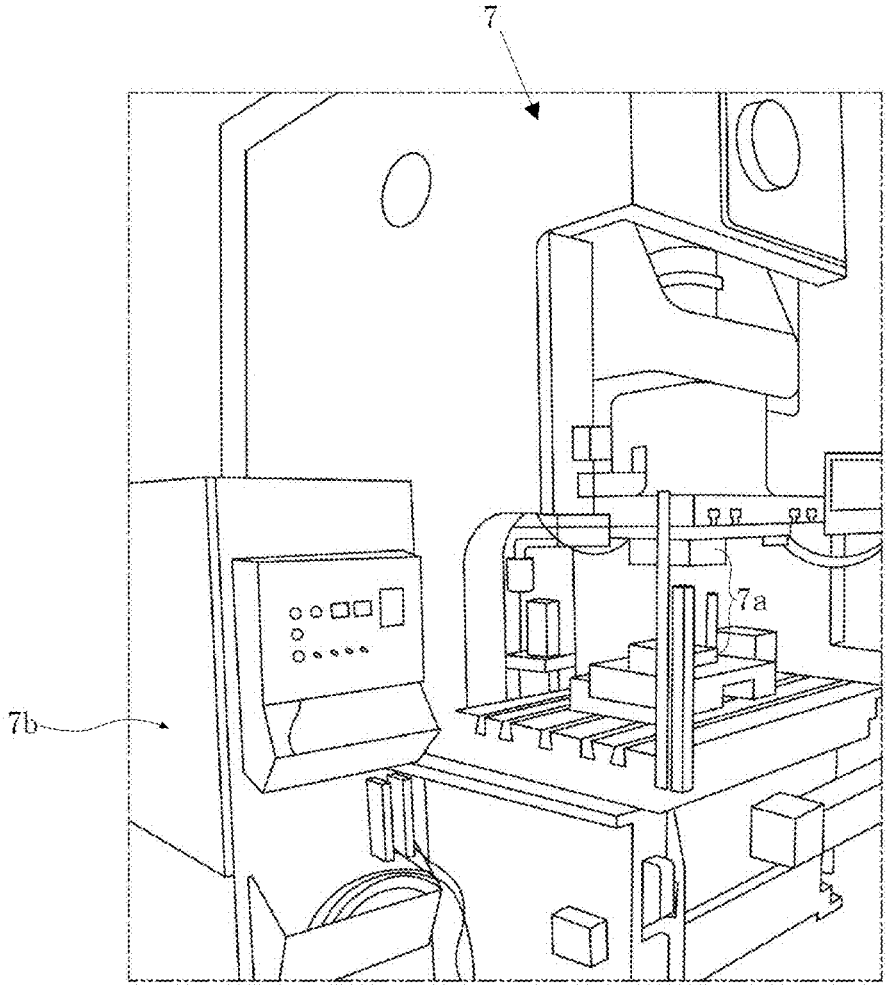

thickness : 1 0 mm thickness : 9 mm

METHOD OF MANUFACTURING PURE NIOBIUM PLATE END-GROUP COMPONENTS FOR SUPERCONDUCTING HIGH FREQUENCY ACCELERATOR CAVITY

TECHNICAL FIELD

The present invention relates to a method of manufacturing pure niobium plate end-group components for superconducting high frequency accelerator cavity, featuring the conversion of the forming procedure from the conventional machining or waterjet cutting followed by cold forging to the whole press-forming.

BACKGROUND ART

Lately, along with the discovery of Higgs particles and development of Big Bang and Inflation Theories, the construction project of the international linear collider (ILC), which is a linear accelerator with a length of as long as 30 to 50 km, has been in steady progress.

The core devices of the ILC are superconducting high frequency accelerator cavities, whose single unit is called a "9-cell cavity". Each unit is composed of a center component 2 made of nine cells and end-group components 3 on both sides of a unit as shown in FIG. 1. The end-group component 3 is constituted by a HOM (High Order Mode) coupler 3*c* having a complicated shape and ports (a beam pipe 3*a* and a port pipe 3*b*) and so on for power input and its monitoring.

The HOM coupler 3*c* integrates, as shown in FIG. 2, a HOM cup 4 and a HOM antenna 5. That is, when a particle beam is accelerated in electro-magnetic fields and passes through the cavity, the HOM (High Order Mode) wave is excited and prevents the acceleration of the beam. This wave needs to be sucked out of the cavity and modulated. This function can be conducted by the HOM coupler (HOM moderator).

Primary materials of a 9-cell unit and the end-group component 3 are both pure niobium, one of rare metals. The main reason is that pure niobium has as high superconducting transition temperature as 9.2 K, and by using it at 2 K, there is a strong possibility to obtain a high acceleration voltage per unit length of a cavity, the most important superconductive cavity characteristics of ILC, due to easier acceleration of the particle beam.

Pure niobium is a material which is extremely expensive and tough for machining and press-forming The main reasons are a low plastic strain ratio in press-forming and seizure with tooling. The HOM antenna 5 is conventionally made into a final product by full machining or firstly into a near net shape semi-product by waterjet cutting then into a final product by cold forgoing.

The HOM cup 4 is produced by full machining or backward extrusion followed by machining and heat treatment or plural processes press-forming with final heat treatments.

All of them involve serious problems in terms of productivity and cost-effectiveness. Therefore conversion of production method to advanced whole press-forming has been strongly desired in order to sort out the issues.

Thus, the inventors have had R&D works concerning HOM cup 4 to attain the conversion of a production method to innovative ultra-deep drawing procedure, and have already filed domestic and international patent applications (Patent Documents 1 and 2).

However, the HOM antenna 5 is, as is judged from an appearance in FIG. 2D, a "tough-workable shape component" for press-forming procedure. Pure niobium, herein, is a "tough-workable material" both in mechanical cutting and press-forming Further the HOM antenna 5 is of a "plate" with an initial thickness of approximately 10 mm. These lead to high barriers to be sorted out.

In the HOM antenna 5, in order to have proper superconducting characteristics, dimensions are important, including plate thickness and R value (plastic strain ratio) at a variety of angles from the rolling direction of a plate material. In the conversion from machining to press-forming of the end-group components 3, R &D works of both "material technology" and the "plastic working technology" are simultaneously needed. The radius of perforation in a nearly square product is very small, stress concentration can easily be generated. Hence the occurrence of necking/crack, metal surplus/shortage, shape fixability and residual stress are expected to lead to severe forming difficulty.

Moreover, CP (chemical polishing) and EP (electrolytic polishing) are performed as a finishing process, wherein, for the purpose of reduction of load given, the surface condition without the presence of foreign objects and small amount of impurity elements on or slightly below the material surface should be properly arranged.

Thus, any working method of the HOM antenna 5 other than full machining or waterjet cutting followed by cold forging has been neither known nor established. Significant improvement of mass productivity and reduction of a manufacturing cost by means of conversion of forming procedure from machining or waterjet cutting followed by conventional cold forging is extremely required.

As a method for meeting the requirement, the present invention gives an achievement resulted from R&D works for the materialization of an idea which has not been tried. This is "innovative full press-forming" composing of advanced technologies of an "innovative shear-blanking method" and a subsequent "innovative forging method" for the conversion of prior methods to the full press-forming.

Firstly, the above R &D works excluded both conventional shear-blanking and fine blanking, because, in the former, a clearance is usually 5 to 10% of the plate thickness (t), thus, it was impossible to realize a required dimensional accuracy, while in the latter, due to elevated costs caused by an expensive exclusive machine and an expensive tooling die plus high technical difficulty, production efficiency comes to be a serious problem.

Prior to examination of the "innovative shear-blanking method", the inventors evaluated a possibility of producing a near net shape semi-product using the "waterjet cutting" instead of mechanical cutting because it was seemingly available. Since relatively high speed and high efficiency are expected for the production of the near net shape semi-product by waterjet cutting, various examinations were conducted in parallel with the subsequent promising procedure by press-forming i.e. the well-known "cold forging".

As a result, a couple of technical problems were recognized. The one was the presence of foreign objects on the metal surface found by SEM observation and EDX analysis after waterjet cutting followed by CP. They were also intruded into the matrix right below the surface (FIG. 3). It was clearly seen from a SEM image (FIG. 3A) that white point ranging in size from several μm to several tens of μm were scattered, and that a color tone of their periphery thereof was changed probably due to stress fields.

From the EDX measurement of an observed white spot encircled, for instance, in the SEM image (FIG. 3B), it was identified to be alumina, silica, iron oxide, magnesium oxide and the like. The existence of these foreign objects is speculated to be caused by "fillers" used in waterjet cutting to easily produce the near net shape semi-product. As long as this cutting method is used, remaining and intrusion of the fillers on and slightly below the surface of semi-products cannot be avoided.

When the fillers remain in the products, there is a serious concern that the occurrence of a high-frequency resonant mode is enhanced, which gives a unfavorable influence on the cavity performances and thus, there is no choice but to avoid the waterjet cutting to manufacture the near net shape semi-products. Moreover, it is undeniable that the waterjet cutting is poorer in productivity and cost effectiveness than the press shear-blanking In the case of HOM antenna 5, approximately 10 minutes are required to produce one piece, so that the waterjet cutting procedure is not suitable for mass production of several tens of thousands pieces of HOM antenna needed for ILC project.

Secondly, as the production method of a near net shape semi-product into a final product, availability of the conventional cold forging was investigated. However, as a result of experimental works, problems such as necking, dimensional irregularity, stress concentration and shape fixability (shear droop, bur, and metal surplus/shortage) were found in addition to a problem of seizure as well. Common factors of these problems are associated with "plastic metal flow of the formed material related to applied force" between the material and the tooling die.

Among them, local occurrence of the necking after the cold forging as shown in FIG. 4 is a serious problem in particular. Experiments were conducted by changing cold forging conditions regarding plastic formability. But the results showed the impossibility of complete avoidance of necking generation (exhibited by an ellipse in the FIG. 4).

Even if necking formation is of remarkably small probability, just a single necking deteriorates the function of the HOM antenna 5 to bring about serious damage to the whole operation of the accelerator. Therefore necking defect should be absolutely averted.

It is certain that the necking was directly caused by stress concentration, but it is not known yet which of insufficient strength of the material, poor ductility, deficient plastic metal flow, or a small margin of further deformation of the material is a primary factor.

Either remnants of fillers or necking generation is caused by the interaction between the material and its deformation. It is certain that each phenomenon deteriorates the control of the resonant frequency mode or superconductivity itself after combining HOM antenna with HOM cup and the following electron beam welding (EBW), so that remnant fillers and necking defects should be prevented. This is why R&D works developing an innovative production method of HOM antenna 5 by paying attention to both material and working/forming is extremely essential.

TECHNICAL REFERENCES

Patent Documents

[Patent Document 1] JP-A-2013-152686
[Patent Document 2] WO2013/115401 A1
[Patent Document 3] JP-A-H07-48589

SUMMARY OF THE INVENTION

Task to be Solved by the Invention

Thus, targeting mass production, the present invention aims at materialization of an advanced method of manufacturing pure niobium plate end-group components from pure niobium plate material for superconducting high frequency accelerator cavity, wherein the invention is to convert the procedure/production method from the conventional machining or waterjet cutting followed by the conventional cold forging to the whole press-forming.

Solution to Problems

As a result of the aforementioned R&D works, the inventors have attained the solution by creating a new press-forming technology, composing of innovative shear-blanking method to produce a near net shape semi-product, then followed by an innovative forging method to produce a final product.

More specifically, in order to sort out the aforementioned problems, the present invention is:

[1]

A method of manufacturing pure niobium plate end-group components for superconducting high frequency accelerator cavity used for the acceleration of charged particles, composing of (1) shear-blanking procedure of said pure niobium plate different from the conventional fine blanking, wherein the clearance that is defined as a gap between outer and inner diameters of the respective shear-blanking punch and die is set to be very small value below 0.5% of pure niobium plate thickness to form a near net shape semi-product free from foreign objects on and below the material surface under the restriction of the material on binding tool to generate counter force, and (2) forging procedure at different temperatures from any of the conventional hot or warm or cold forging, wherein press forging is conducted to be free from the occurrence of blue brittleness/necking and to bring about prominent metal-flow, sufficient formability, the size accuracy in any portion of a product and the margin of further press-forming by controlling forging temperature to be below 200° C. and beyond ambient room temperature, and characterized in that manufacturing method such as full machining or waterjet cutting followed by cold forging of said pure niobium plate end-group components is converted to the whole press-forming method.

[2]

Aforementioned method of shear-blanking pure niobium plate end-group components described in [1], wherein it is featured that successive shear-blanking at higher speed than 100 mm/sec is carried out on said pure niobium plate and that shear-blanking tooling die is installed with the cooling device for extraction of heat generated in said procedure.

[3]

Aforementioned method of shear-blanking pure niobium plate end-group components described in [1], wherein it is featured that shear-blanking speed and motion are controlled by the installation of servo mechanism to a press machine including multi-synchronized operation of blank holding force and surface pressure/stress of said material by use of the respective multi-action die and servo-die cushion.

[4]

Aforementioned method of forging pure niobium plate end-group components at said controlling forging temperature described in [1], wherein it is featured that the formation of surface oxidation film of said near net shape semi-product is temperature-controlled in order to be minimized.

[5]

Aforementioned method of forging pure niobium plate end-group components at said controlling forging temperature described in [1], wherein it is featured that plastic metal-flow of said near net shape semi-product is temperature-controlled to be easily promoted.

[6]

Aforementioned method of manufacturing pure niobium plate end-group components described in [1], wherein it is featured that grain diameter of said material is several 10 μm to form the proper configuration of fine-grained crystallographic texture.

[7]

Aforementioned method of forging pure niobium plate end-group components described in [1], wherein it is featured that tooling die and punch for said forging are surface-treated followed by being subject to solid-state film type lubricant having dynamic friction behavior independent upon temperature in order to prevent the material from seizure.

[8]

Aforementioned method of manufacturing pure niobium plate end-group components described in [1], wherein it is featured that a press machine is servo-mechanized to control both speed and motion in said shear-blanking and forging

[9]

A method of manufacturing pure niobium plate end-group components for superconducting high frequency accelerator cavity used for the acceleration of charged particles, composing of (1) shear-blanking procedure of said pure niobium plate different from the conventional fine blanking, wherein tooling punch and die having very small clearance that is defined as a gap between outer and inner diameters of the respective shear-blanking punch and die, cooling-functional device to extract heat generated during successive shear-blanking at high speed on said tooling punch and die, binding tool for preventing movement of said pure niobium plate, multi-action die to control external forces given by press machine tools, servo-die cushion to control blank holding force and surface stress of said pure niobium plate, a press machine installed with servo mechanism for controlling of speed and motion of said pure niobium plate, are all integrated in order to perform shear-blanking of said pure niobium plate material into near net shape semi-products, and (2) forging procedure at different temperature from any of the conventional hot, warm, or cold forging, wherein said tooling punch and die along with heating-cooling device to avoid blue brittleness/necking and to promote plastic metal flow/margin of further press-forming, tooling punch and die aiming at the improvement of formability and minimization of surface oxidation by conducting surface treatment, temperature independent solid-state film type lubricant having temperature independent lubricity to prevent seizure between said near net shape semi-product and forging tools, press machine installed with servo mechanism to control speed and motion of said near net shape semi-product, in order to press-form said near net shape semi-product into final forged product from the original pure niobium plate, are all integrated in order to perform forging of said near net shape semi-products, and characterized in that manufacturing method of the conventional machining or waterjet cutting followed by cold forging of said pure niobium plate end-group components is converted to the whole press-forming method.

[10]

A method of manufacturing pure niobium plate end-group components described in any one of [1] to [9], wherein said product is characterized to be HOM antenna manufactured by said whole press-forming

Advantageous Effects of the Invention

The present invention is a technology for producing end-group components using a pure niobium plate by a coordinated inventions of the shear-blanking process to press form a near net shape semi-product without employing machining or waterjet cutting and also fine blanking as well, and the following forging process different from any one of the conventional hot or warm or cold forging process to press form the above semi-product to a final product.

As a result, the problems of remaining fillers on the material surface caused by waterjet cutting and generation of necking caused by cold forging are settled, whereby the material yield of expensive pure niobium comes up to lead to reducing material cost. Additionally, it should be noted that a stable operation of the accelerator can be assured. Moreover, since finishing processes are applied to as-pressed products, manufacturing time is reduced, whereby a manufacturing cost can be drastically lowered. It should be notable that the contribution to stable mass production and component supply can be materialized.

BRIEF DESCRIPTION OF THE DRAWINGS

FIG. 3A and FIG. 3B are informative data from the conventional waterjet cutting of a pure niobium plate. FIG. 3A is a SEM image of a surface of a near net shape semi-product obtained by waterjet cutting, and FIG. 3B is a result of an EDX analysis of a particle surrounded by white circle in FIG. 3A.

FIG. 4A is an appearance of a cold forged product, and FIG. 4B is a close-up within a circle in FIG. 4A, wherein necking can be seen.

FIG. 5A and FIG. 5B are an illustration of a binding method of the thick pure niobium material in shear-blanking FIG. 5A is a B-B' sectional schematic view of FIG. 5B together shown with a material and a tool, and FIG. 5B is an A-A' arrow-view schematic drawing in FIG. 5A.

FIG. 6 shows a blue-brittleness temperature region shown in the relationship between strength/elongation vs. temperature diagram.

FIG. 7 is an appearance of a servo-press machine 7 on which various control mechanisms and a tooling die used for press-forming in the present invention and a heating/cooling controlling equipment are mounted.

DESCRIPTION OF EMBODIMENTS

Figure 1:
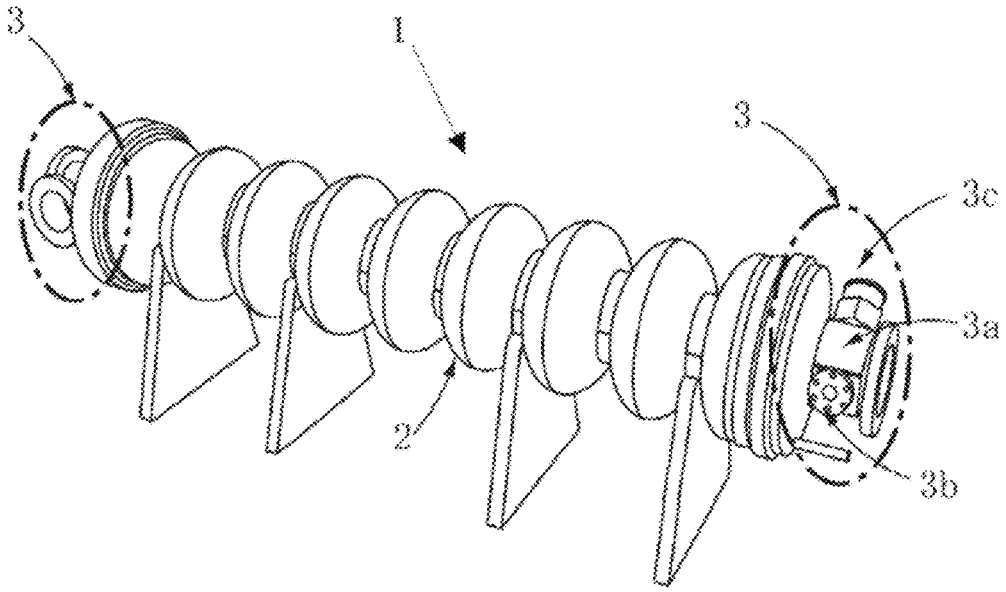
Fig. 1 Background Art
FIG. 1 is an appearance of a superconducting high frequency 9-cell accelerator cavity whereto a pure niobium end-group is attached.
Figure 2A:
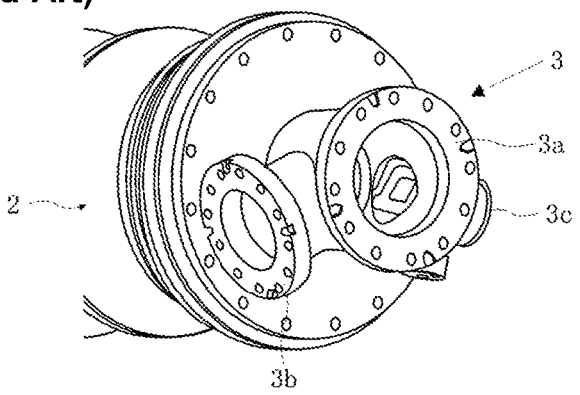
FIG. 2A (Background Art)
FIG. 2A, FIG. 2B, FIG. 2C and FIG. 2D are a schematic view of a HOM coupler constituting the pure niobium end-group of a superconducting high frequency accelerator cavity and a HOM cup and a HOM antenna integrating the HOM coupler.
Figure 2B:
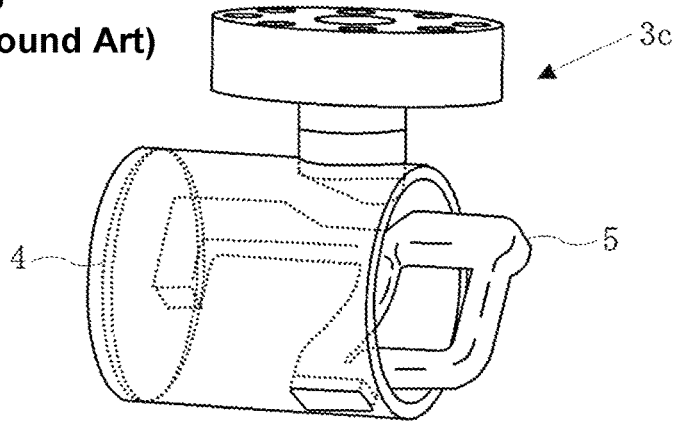
FIG. 2B (Background Art)
Figure 2C:
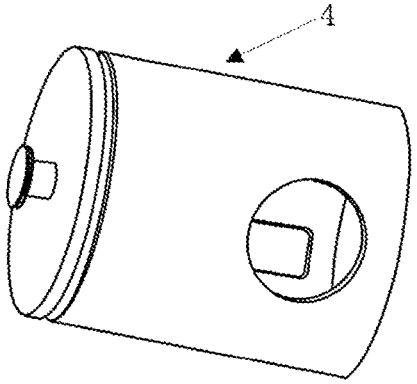
FIG. 2C (Background Art)
Figure 2D:
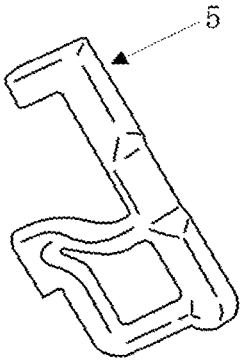
FIG. 2D (Background Art)

The present invention will be described below in details on the basis of FIGS. 5 and 6.

A HOM antenna 5 in pure niobium plate end-group components for superconducting high frequency accelerator cavity 3 used for acceleration of charged particles, is manufactured by innovative shear-blanking method (1) and innovative forging method (2) according the present invention. This enables the conversion of the conventional machining or waterjet cutting followed by the conventional cold forging to the whole press-forming method.

(1) Shear-blanking of the Invention

1) Shear-blanking

Shear-blanking is a process of forming a near net shape semi-product 5*b* from a pure niobium plate 5*a*, wherein are included: minimization of a clearance between a die 6*a* and a punch 6*c*, tooling system for binding 6 for a pure niobium plate 5*a*, high speed blanking system, a cooling function for heat extraction, a multi-action die, a servo-die cushion, and a servo-control of a press machine They are appropriately combined to integrate the whole system of the invention. Each process and its effect will be described below.

2) Very Small Clearance 6*e*

As shown in FIG. 5A, a very small clearance 6*e* herein is a gap between the die 6*a* and the punch 6*c* set to a very small value of 0.5% or less of a plate thickness (t) of a material to obtain a highly accurate shear-blanking product. In the conventional blanking, 10 to 15% of the plate thickness (t) is normally adopted, and in a fine blanking (FB), it is below 0.5%. However, the FB has problems such as an expensive special press machine possessing a V-shape protrusion on a die, a low blanking speed, and a tough operation of the press machine system.

3) Innovation of Shear-blanking

On the other hand, by developing of the following integrated technology, the present invention provides the innovative shear-blanking method which can be applied to tough-workable press-forming material like the pure niobium plate 5*a*, different from either conventional blanking or FB method.

4) Tooling System for Binding 6

This is, as exemplified in FIG. 5, to restrain the movement and swelling of the pure niobium plate 5*a* or to control the plate thickness fluctuation of the near net shape semi-product 5*b* without employment of V-shape protrusion on a die in FB method.

As shown again in FIG. 5, a normal blank holding force Pb is applied to the pure niobium plate 5*a* from above and below (given by the motion of a blank holder 6*d* and the die 6*a*). In the case, a holding counter force Pp is applied to a blanking force Pf in accordance with a degree of droop of the pure niobium plate 5*a*.

Moreover, in the present invention, a binding force F is applied to the pure niobium plate 5*a*. F is composed of a binding force on one side F1, which is applied to a longitudinal side surface of the pure niobium plate 5*a* and a binding counter force on the other side F2, which is applied herein a to a latitudinal side surface of the material. It is referred herein that F1' is a counter force of F1 and F2' is a counter force of F2.

In this case it is essential to keep control the following equation:

$$Pb=F1+F2 \quad (1)$$

As a result, plate thickness fluctuation of the pure niobium plate 5*a* in shear-blanking can be satisfied in obedience to a required tolerance.

5) Application of Servo-die Cushion

Here, since dynamic control of Pb during innovative shear-blanking by a servo-die cushion is performed in the present invention, F can be looked upon as a factor which varies according to servo-die cushion functioning as a rule.

It was recognized during blanking that the pure niobium plate 5*a* moves under the blank holding force applied by either conventional blank holder or FB blank holder with V-shape protrusion. And then the thickness of the near net shape semi-product 5*b* is decreased. In consideration of the fact, innovation concepts could be reached the target of the thickness tolerance by adjusting the respective controlling factors as mentioned above.

6) Successive High-speed Blanking

During blanking of the pure niobium plate 5*a*, it was found by increasing a punch speed to 100 mm/sec or more, for example, that the shear blankability improved. Such high speed blanking is impossible by a hydraulic mechanism in FB. Thus, the present invention has made it realizable by a press machine mounted on electric servo control mechanism which will be described later.

A mechanism pf improving the blankability in high-speed operation in pure niobium has not been known. The inventors have found from the viewpoint of material science that the blocking effect on the micro deformation of matrix (mainly related to easing of cross slip caused by rise of stacking fault energy), namely micro slip and its tangling (mainly related to easing of cross slip caused by the elevation of stacking fault energy in parallel with high speed shearing) weakens during plastic deformation of the pure niobium material.

7) Heat Extraction

On the other hand, by increasing the blanking speed and performing successive shearing, an amount of transformation of external force into thermal energy is increased/accumulated, which results in heat generation and raises a tooling die temperature. Then, atom-to-atom mutual interaction between the tooling die and the surface of the pure niobium plate 5*a* increases. Hereafter the lubricant and surface-treated film coated on the die/punch create chemical reaction to be dominantly oxides formation which causes "seizure ". Thus, "heat extraction" of the deformed material and the tooling die subject to friction is required during the successive shear-blanking, and the tooling die should be cooled with a temperature control device to extract excessive heat from the material by heat conduction.

8) Multi-action Die

The press machine basically and customarily operates with 2 axes loading (slide and blank holder). Besides, when by multi-action die adding a servo function was mounted on a conventional press machine irresitive of a complicated mechanism as in the FB, "counter force" (a third axial force) in a direction opposite to the direction of a slide force can be generated (3 axes loading similar to FB method).

In order to produce the highly accurate near net shape semi-product 5*b* with a very small clearance 6*e*, an effect of improvement of such simple triple actions/axes cannot be ignored (corresponding to Pp in FIG. 5). As a result, it was found that an initial investment cost in the shear-blanking apparatus can be dramatically declined to be enable the reduction of the mass production cost of the near net shape semi-product 5*b*.

9) Servo-die Cushion

Servo-die cushion is installed to make blank holding force (surface pressure) in shear-blanking of the pure niobium plate 5*a* controllable for its performance. Due to the short blanking time, such dynamically variable control of the surface pressure involves difficulty, but it was available to put into practice by the improvement of a response speed of a feedback sensor. This mechanism brings about highly accurate/highly efficient shear-blanking by combined employment with other proper systems described herein so as to imply the exertion of synergic effects.

10) Servo Control of Press Machine

Though this is a well-known method/device in press-forming, servo control is an essential constituent in the present invention characterized by the effective use of high-speed/successive shear-blanking and its speed/motion control. Such idea has not been publicized so far.

(2) Forging of the Invention

1) The Forging Invented

Subsequently, the present innovative forging is a process of fabricating the near net shape semi-product 5*d* into a final product 5*c*. The process provides appropriate combinations of the following procedures, including forging at beyond ambient room temperature to 200° C. (in view of blue brittleness/necking, minimizing the surface oxide film formation, and enhancing the plastic metal flow), selection of fine crystal grains of pure niobium material, a tooling die subjected to surface-treated improvement, proper lubrication, and servo-control of the press machine Their procedures/effects will be described below.

2) Temperature Control

For the sake of blue brittleness/necking of pure niobium, minimizing of the surface oxide film formation, and enhancing of the plastic metal flow, temperature control is executed on the condition of beyond room temperature (RT) and below 200° C. Preferably, it shall be from 50 to 150° C.

Conventionally, the followings are known with regard to temperature conditions in the forging:

Hot forging ⇒ beyond recrystallization temperature, roughly >800° C.,

Warm forging ⇒ 300 to 800° C., and

Cold forging ⇒ RT (room temperature).

The temperature employed in the present invention does not belong to any of the respective conventional temperature conditions, and provides an innovative forging method suitable for shear-blanking of tough-workable material like pure niobium.

3) Blue Brittleness/Necking

As a result of examinations of temperature dependence of static mechanical characteristics of pure niobium (FIG. 6), valuable information related to innovative procedures and effects of press-forming of the pure niobium plate 5*a* was obtained, whereby an advanced idea connected with the innovative forging was acquired and reached the present invention.

FIG. 6 shows results of static single axis tensile test of pure niobium at 0 to 400° C. A horizontal axis indicates temperature, vertical axis (left) shows elongation (ductility), and the other one (right) exhibits tensile strength (force of the material). Regarding EL (total elongation), results of different charges are plotted in the figure.

From the above, the static mechanical properties of the pure niobium do not change uniformly (i.e. increase/decrease/stable) to temperature changes. Particularly, in a temperature region of 200 to 300° C., both ductility and strength are rapidly reduced. This shall be referred to as "blue brittleness" based on metallurgy, leading to necking defects.

When the blue brittleness occurs, drop of plastic deformability caused by lowered ductility and reduction of deformation resistance to an external force of the material. This leads to the deterioration of material strength. Thus, a risk of formability drop of a pure niobium material tends to generate "necking" due to a stress concentration. Therefore blue brittleness should be completely avoided in the present forging.

Figure 4A:
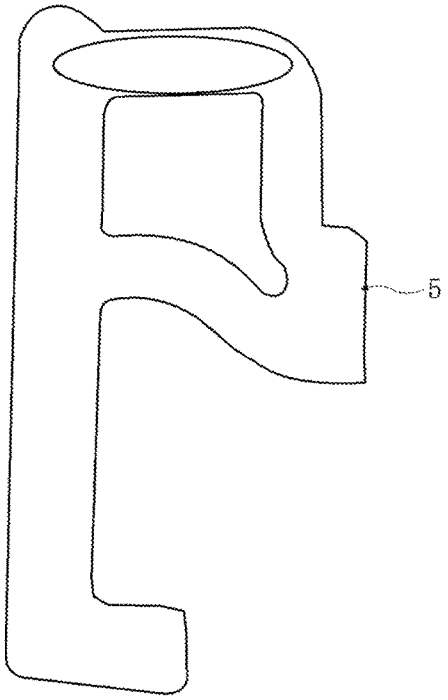
FIG. 4A (Background Art)
FIG. 4A and FIG. 4B are a picture of cold forged product of a near net shape semi-product press-formed by the conventional waterjet cutting.
Figure 4B:
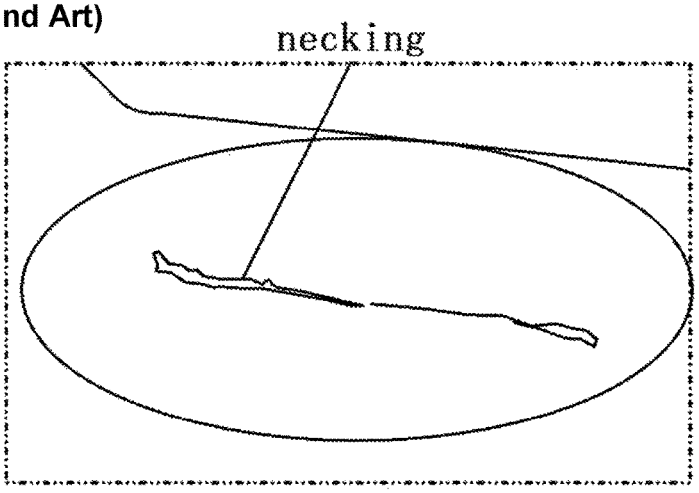
FIG. 4B (Background Art)

A generation of blue brittleness/necking in niobium happened to be as shown in FIG. 4. This relates to "optional use of pure niobium having fine grains" to be described later. Further, as suggested from a flow stress change shown by a circle of a stress-strain curve inserted in FIG. 6, this is caused by interaction/blocking of solid diffusion of interstitial atoms (carbon and nitrogen) at grain boundaries and accumulated sites of micro-slips in the pure niobium material.

Diffusion (shown by diffusion coefficient, D) in ferrite (body-centered cubic lattice (BCC)) such as pure niobium is expressed by the following equation, wherein D depends on temperature T:

$$D=D_0 \exp(-Q/kT) \tag{2}$$

wherein $D_0$: frequency factor, Q: activation energy, k: Boltzmann constant.

A diffusion distance Δx (implying diffusion speed) of an atom at time t is expressed as follows:

$$\Delta x=\sqrt{Dt} \tag{3}$$

Since D values of carbon and nitrogen in the ferrite at 200 to 300° C. is approximately $10^{-10}$ $cm^2$/sec, the compatibility to the micro-slip speed brings about interaction/blocking, whereby blue brittleness/necking is to be caused.

In addition, the "easing of plastic metal flow" should be taken into consideration along with "optional use of pure niobium with fine grains," both of which will be described later.

4) Minimizing of the Surface Oxide Film Formation

Pure niobium has small standard chemical formation free energy,ΔG, for oxides (mostly $Nb_2O_5$) and is easily oxidized. In order to remove scale (oxide film), final surface treatments (mechanical/chemical (Cp)/electrolytic (Ep)) are carried out on a press-forged product. Particularly, Ep needs to be done to each unit of a single "9-cell cavity", actually about 20,000 units in total. Thus, the reduction of oxide film as possible contributes to the improvement of EP processing capacity, whereby a cost is reduced.

Therefore, a forging temperature is preferably as a low value as possible beyond room temperature and below 200° C. However, in addition to considering the avoidance of blue brittleness/necking, a change in flow stress indicated in the stress-strain diagram inserted in FIG. 6 should be included, which gives an adverse effect to press-forming based on similar reason to that of blue brittleness i.e. by interaction of micro-slip strain related to interstitial atoms as described above. It is called "aging" and is likely to occur even at a high temperature close to a blue brittleness temperature as well as lower temperature. And regarding easing of plastic metal flow described later. Then, favored temperature controlled in the invention is from 100 to 150° C., preferably in the vicinity of 130° C.

5) Easing of Plastic Metal Flow

As forging process is progressed with the deformation of materials mainly under a compressive force, it is essential how appropriately and uniformly macro plastic metal flow of a pure niobium material is easily generated to form a final product having required shape and dimension.

For the purpose, among mechanical properties, better ductility normally expressed by total elongation and keeping strength/flow stress lower to diminish deformation resistance are desired. In addition, avoidance of interaction with micro deformation strain on the basis of interstitial atoms of carbon and nitrogen described above is desirable.

From the aforementioned viewpoint, the importance of temperature control beyond the ambient room temperature and below 200° C. can be understood by referring to FIG. 6. Simultaneously, the selection of around 130° C., that is in accordance with the temperature for minimum surface oxidation filming, is preferable.

Thus, the improvement of the whole surface formation and an increase in accuracy of said forged product comes to be materialized. It is noted that the present invention derived from R&D experimental works and the theoretical principle, that is, the innovative technology to realize full press-forming of the pure niobium plate to an antenna is not known in the past.

(3) Preparation of Fine Crystal Grains of Pure Niobium Material

This has two viewpoints. The first is the avoidance of seizure (adhesion) occurring between the pure niobium plate 5*a* and the tooling die. Pure niobium has normally high speed grain growth by recrystallization and it usually presents coarse grains approximately several hundreds μm.

The reason is inferred that pure niobium used for the present application has much higher purity of over 300 RRR or more which means that the contents of interstitial impurity elements such as carbon, nitrogen etc. are approximately several ppm each and thus, their blocking of grain boundary movement gets smaller and bulk diffusion of niobium atoms becomes easier.

On the basis of a hypothetical principle that when crystal grains structure of the material is coarse (several handreds of μm in pure niobium in general), an interaction by random walk of atoms between the material surface and the die surface increases in probability rather than the case of fine grains, a chemical reaction takes place frequently, and seizure and wear are promoted. Thus using a pure niobium material with fine grains of several tens of μm should be recommendable for the lowering of the seizure (adhesion).

The fact that the grain size of the pure niobium is one of factors for seizure/adhesion has not been known so far. Moreover, a technology for controlling the grain size to several tens of μm order has not been disclosed.

The second viewpoint is, as is known from the aforementioned description concerning blue brittleness and aging in FIG. 6, that by using the fine grain material with the grain size of approximately 1/10 of the present niobium material as described above, the area of grain boundary is extremely increased and thus, many of the interstitial elements such as carbon and nitrogen are relatively less-interacted (trapped) by the grain boundaries even at the same temperature in both materials. Resultantly the degree of preventing progress of micro slips is decreased. That is, in the forging under the same temperature, blue brittleness or aging is mitigated in the fine grain material compared to the coarse grain material, then the deformation of forging becomes easy and also successive forging after innovative shear-blanking improves.

(4) Surface Treated Die

In order to prevent seizure (adhesion/abrasion) between the tooling die and the pure niobium plate 5*a* and friction/wear of the tooling die, the surface of the tooling die is treated by advanced methods of DLC, low-temperature nitriding, chemical/physical vaporization coating etc. Taking into consideration the soft pure niobium to be forged, care shall be taken for the thickness of the treated layer and pre-treatment of the material surface. In addition, careful attention should be paid to the selection of the die material as well.

(5) Proper Lubricant

A solid-state film type lubricant showing temperature independent lubricity is used herein. For example, a lubricant in which one of the inventors was involved is known to have lubricity not varied in the range from room temperature to 800° C. (Patent Document 3). The seizure/adhesion can be lessened by using this lubricant. The lubricant described in the Patent Document 3 is a solid-state one which avoids an adverse effect to human bodies/environments contrary to chloride added oil lubricant and conventionally used for seizure/adhesion prevention, and also contributes to the improvement of workability.

(6) Servo Control (Motion Control)

This function is for the purpose of achieving speed control and/or motion control of a slide (stroke) of the press machine with the servo system installed in a conventional press machine, wherein the compatibility of the external force to invite micro- and/or macro-deformation mode of the pure niobium plate 5*a* is improved to upgrade plastic workability.

EXAMPLE 1

Detailed descriptions have been made above related to the contents of the invention. Then, a specific example based on them will be shown below by referring to FIG. 7 and FIG. 8. The present invention is, herein, not limited to the following example.

FIG. 7 shows an appearance of equipment/device for putting the invention into practice. A main device is a press machine in which an electric (AC) servo mechanism was installed in a conventional press machine, and moreover, a multi-action die and a servo die-cushion were mounted. Basically from the viewpoint of cost performance in the experiment, the respective stage in the invention was performed using the same single press machine That is, the innovative shear-blanking for forming of the near net shape semi-product 5*b* and the innovative forging for the final product were conducted for appropriate number of units in each method (it is needless to say that the respective press-forming is successively performed by two press machines in mass production).

Thus, the shear-blanking die was replaced to the forging die and vice versa. To change heavy dies, QDC (Quick Die Change System) was used. The tooling die material for the example was SKD11. The advanced surface-treatment was conducted by DLC with the thickness of treated DLC layer of 2 μm. A solid-state lubricant G2578T (supplied by Nihon Kosakuyu Co., Ltd.) was used for lubrication. These die materials, surface-treatment improvement, and lubricant were used for both of the shear-blanking and the forging.

For cooling control for the innovative shear-blanking and heating control for the innovative forging, a temperature control device 7*b* shown in FIG. 7 was used, wherein temperature control is available from −20 to +300° C. by means of non-Freon refrigerant for the cooling and an electric heater built-in the tooling die 7*a* for heating, respectively. A slight time lag was generated between the temperature control of the pure niobium plate 5*a* and the tooling die. It was, however, of no particular problem.

The pure niobium plate of 10 mm thick was used as the experimental material. This was obtained by applying EBM (electron beam melting), whereby the operation was repeatedly several times and then, blooming followed by plate rolling from an ingot subject to vacuum annealing, plus final de-scaling were processed. According to a mill sheet (inspection certificate) of the ingot, impurity soluble atoms such as carbon, nitrogen, oxygen and the like are all at a low level of several ppm, and also RRR (Ratio of Relative Resistivity) was 341 that corresponds to over 300 of target value of ILC Project. Tantalum (belonging to Period VI and Group 5, while Nb is in Period V and Group 5 element in the periodic table respectively, so that the former is hard to be removed from the latter ore.) content was 280 ppm. The grain size was roughly 100 to 300 μm in diameter (slightly larger than ideal value of several tens of μm, though) having substantially equi-axed grains. Crystallographic texture was not measured. Hardness was measured to be approximately 90 from the micro-Vickers hardness test.

Conditions of the experimental example were as follows:

(1) Shear-blanking: (very small) clearance 40 μm; blank holding force (Pb) 20 tons; surface pressure by blank holding 140 kg/cm$^2$; binding force (F) is the same as the surface pressure; blanking force (Pf) 90 tons; backward holding counter force (Pp) 13 tons; speed 200 mm/sec; cooling temperature 0° C.; servo motion straight; number of successive blanked products 50.

(2) Forging: forging force 160 tons; forging speed 0.5 mm/sec; offset amount of near net shape semi-product 5*b* to forging die 0.2 mm; forging temperature 130° C.; the number of successive forged products 50.

According to the present invention a large number of HOM antenna 5, under the aforementioned conditions, examples of a semi-product 5*b* on the innovative blanking from the pure niobium plate 5*a* and a subsequent innovatively forged final product 5*c* are shown in FIG. 8, respectively.

Figure 8A:
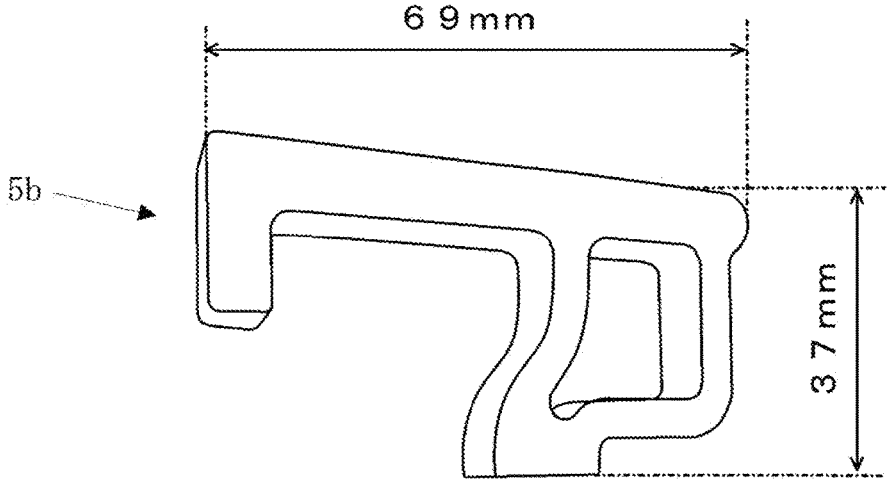
FIG. 8A and FIG. 8B demonstrate a shear-blanked near net shape semi-product according to the present invention (A) and the following forged product (before final polishing) (B).

FIG. 8A shows a shear-blanked near net shape semi-product 5*b*. The shear-blanking of a 10 mm thick pure niobium plate 5*a* with lower strength that is highly difficult for working could be carried out at high speed pressing without any particular problem. It is needless to say that there were no remaining filler which is a serious problem in near net shape semi-products on the waterjet cutting. Therefore the problem hereby can be solved completely.

Figure 8B:
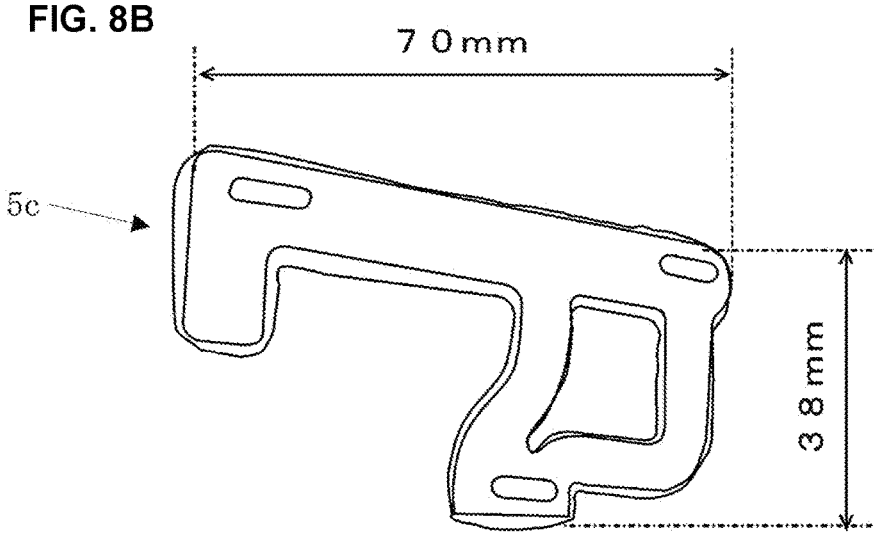

FIG. 8B shows a product (final product 5*c*) after the innovative forging (before the finished machining and surface polishing process) subsequently produced from a FIG. 8A near net semi-product. In this case, too, it turned out that a final product having required shape and dimension/tolerance can be manufactured with satisfied productivity by applying the advanced forging procedure described earlier.

A considerable number of products were shear-blanked and forged by the innovative methods, and there was absolutely neither "foreign objects on and below the material surface" nor "necking defects" which occurred either in the conventional waterjet cutting or cold forging. FIG. 8 shows the length dimensions and the thickness of typical products by the respective methods. Also, it was confirmed that no problem was found in the final polishing-processes after the forgoing.

Particularly, the thickness was decreased by 1 mm and the lengths were also decreased by forging. They were within expectation to be allowable range which was the result of the offset properly established beforehand in a tooling die design as described above.

As a result of the aforementioned example where the invention was applied, it was found that the conversion/replacement of the conventional waterjet cutting and cold forging to the whole press-forming the HOM antenna 5 from the pure niobium plate 5*a* is achieved (except the finishing processing unlike the press-forming) Therefore, increase in material yield, cost reduction and improvement of mass productivity in terms of the manufacturing the accelerator cavity forming methods which have been serious of problems can be materialized by the present invention of the whole press-forming methods.

NOTATION IN FIGURES

1 superconducting high frequency accelerator cavity
2 center component
3 end-group component
3*a* beam pipe
3*b* port pipe
3*c* HOM coupler
4 HOM cup
5 HOM antenna
5*a* pure niobium plate
5*b* near net shape semi-product
5*c* final product
6 tooling system for binding
6*a* die
6*b* blank holder
6*c* punch
6*d* backward blank holder
6*e* very small clearance
6*f* binding tool
6*g* binding tool
6*h* binding tool
Pf blanking force
Pb blank holding force
Pp backward holding force
F binding force
F1 binding counter force on one side
F1' counter force
F2 binding counter force on the other side
F2' counter force
7 servo-press machine
7*a* tooling die
7*b* temperature control device

The invention claimed is:

1. A method of manufacturing pure niobium plate end-group components for superconducting high frequency accelerator cavity used for an acceleration of charged particles, composing of (1) shear-blanking procedure of a pure niobium plate different from a conventional fine blanking, wherein a clearance that is defined as a gap between outer and inner diameters of respective shear-blanking punch and die is set to be very small value below 0.5% of pure niobium plate thickness to form a near net shape semi-product free from foreign objects on and below a material surface under restriction of the material on binding tool to generate counter force, and (2) forging procedure at different temperatures from any of conventional hot or warm or cold forging, wherein press forging is conducted to be free from occurrence of blue brittleness/necking and to bring about prominent metal-flow, sufficient formability, size accuracy in any portion of a product and a margin of further press-forming by controlling forging temperature to be below 200° C. and beyond ambient room temperature, wherein a manufacturing method of full machining or waterjet cutting followed by cold forging of said pure niobium plate end-group components is converted to a whole press-forming method.

2. Aforementioned method of shear-blanking pure niobium plate end-group components according to claim 1, wherein successive shear-blanking at higher speed than 100 mm/sec is carried out on said pure niobium plate and that shear-blanking tooling die is installed with a cooling device for extraction of heat generated in said procedure.

3. A method of manufacturing pure niobium plate end-group components according to claim 2, wherein a product produced by the method is characterized to be HOM antenna manufactured by said whole press-forming.

4. Aforementioned method of shear-blanking pure niobium plate end-group components according to claim 1, wherein shear-blanking speed and motion are controlled by installation of servo mechanism to a press machine including multi-synchronized operation of blank holding force and surface pressure/stress of said material by use of respective multi-action die and servo-die cushion.

5. A method of manufacturing pure niobium plate end-group components according to claim 4, wherein a product produced by the method is characterized to be HOM antenna manufactured by said whole press-forming.

6. Aforementioned method of forging pure niobium plate end-group components at said controlling forging temperature according to claim 1, wherein formation of surface oxidation film of said near net shape semi-product is temperature-controlled in order to be minimized.

7. A method of manufacturing pure niobium plate end-group components according to claim 6, wherein a product produced by the method is characterized to be HOM antenna manufactured by said whole press-forming.

8. Aforementioned method of forging pure niobium plate end-group components at said controlling forging temperature according to claim 1, wherein plastic metal-flow of said near net shape semi-product is temperature-controlled to be easily promoted.

9. A method of manufacturing pure niobium plate end-group components according to claim 8, wherein a product produced by the method is characterized to be HOM antenna manufactured by said whole press-forming.

10. Aforementioned method of manufacturing pure niobium plate end-group components according to claim 1, wherein a grain diameter of said material is several 10 μm to form a proper configuration of fine-grained crystallographic texture.

11. A method of manufacturing pure niobium plate end-group components according to claim 10, wherein a product produced by the method is characterized to be HOM antenna manufactured by said whole press-forming.

12. Aforementioned method of forging pure niobium plate end-group components according to claim 1, wherein tooling die and punch for said forging are surface-treated followed by being subject to solid-state film type lubricant having dynamic friction behavior independent upon temperature in order to prevent the material from seizure.

13. A method of manufacturing pure niobium plate end-group components according to claim 12, wherein a product produced by the method is characterized to be HOM antenna manufactured by said whole press-forming.

14. Aforementioned method of manufacturing pure niobium plate end-group components according to claim 1, wherein a press machine is servo-mechanized to control both speed and motion in said shear-blanking and forging.

15. A method of manufacturing pure niobium plate end-group components according to claim 14, wherein a product produced by the method is characterized to be HOM antenna manufactured by said whole press-forming.

16. A method of manufacturing pure niobium plate end-group components according to claim 1, wherein a product produced by the method is characterized to be HOM antenna manufactured by said whole press-forming.

17. A method of manufacturing pure niobium plate end-group components for superconducting high frequency accelerator cavity used for an acceleration of charged particles, composing of (1) shear-blanking procedure of a pure niobium plate different from a conventional fine blanking, wherein tooling punch and die having a very small clearance that is defined as a gap between outer and inner diameters of respective shear-blanking punch and die, cooling-functional device to extract heat generated during successive shear-blanking at high speed on said tooling punch and die, binding tool for preventing movement of said pure niobium plate, multi-action die to control external forces given by press machine tools, servo-die cushion to control blank holding force and surface stress of said pure niobium plate, a press machine installed with servo mechanism for controlling of speed and motion of said pure niobium plate, are all integrated in order to perform shear-blanking of a pure niobium plate material into near net shape semi-products, and (2) forging procedure at different temperature from any of conventional hot, warm, or cold forging, wherein said tooling punch and die along with a heating-cooling device to avoid blue brittleness/necking and to promote plastic metal flow/margin of further press-forming, tooling punch and die aiming at an improvement of formability and minimization of surface oxidation by conducting surface treatment, temperature independent solid-state film type lubricant having temperature independent lubricity to prevent seizure between said near net shape semi-products and forging tools, press machine installed with servo mechanism to control speed and motion of said near net shape semi-products, in order to press-form said near net shape semi-products into final forged products from an original pure niobium plate, are all integrated in order to perform forging of said near net shape semi-products, wherein a manufacturing method of conventional machining or waterjet cutting followed by cold forging of said pure niobium plate end-group components is converted to a whole press-forming method.

18. A method of manufacturing pure niobium plate end-group components according to claim 17, wherein a product produced by the method is characterized to be HOM antenna manufactured by said whole press-forming.

* * * * *